United States Patent [19]

Singer

[11] 4,298,202

[45] Nov. 3, 1981

[54] BOARD GAME USING MOVABLE TRANSPARENT OVERLAY

[76] Inventor: Gilbert L. Singer, Rte. 4, Box 223a, Idaho Falls, Id. 83401

[21] Appl. No.: 88,390

[22] Filed: Oct. 26, 1979

[51] Int. Cl.[3] ..... A63F 3/00

[52] U.S. Cl. ..... 273/247

[58] Field of Search ..... 273/244–245, 273/247, 240, 284, 94, 85 R, 85 F

[56] References Cited

U.S. PATENT DOCUMENTS

| | | | |
|---|---|---|---|
| 1,273,675 | 7/1918 | Schmitt | 273/247 |
| 1,615,982 | 2/1927 | Jewett | 273/245 |
| 3,260,526 | 7/1966 | Seitz | 273/245 |
| 3,612,534 | 10/1971 | Browne | 273/245 |
| 3,819,185 | 6/1974 | Lowther | 273/245 |
| 3,949,992 | 4/1976 | Battis | 273/244 |

FOREIGN PATENT DOCUMENTS

| | | | |
|---|---|---|---|
| 1520009 | 4/1968 | France | 273/247 |
| 347370 | 4/1931 | United Kingdom | 273/245 |
| 537265 | 6/1941 | United Kingdom | 273/247 |

*Primary Examiner*—Richard C. Pinkham
*Assistant Examiner*—Scott L. Brown
*Attorney, Agent, or Firm*—Harvey B. Jacobson

[57] ABSTRACT

A board game simulative of sports games involving the use of a ball which enables the players of the game to use strategy in the movement of the ball and players in a manner similar to that of the actual games. The board game includes a gameboard simulative of the actual playing field, court or the like on which the game to be simulated is played. A number of discs indicative of the players on a team are positioned on the gameboard in a manner selected by players within the limits of rules of play and the player indicates or selects a target for the ball as a specific location on the board. A spinner is provided to indicate whether the ball reached the indicated target or if it missed the target and to indicate the final position of the ball in relation to the selected target. A transparent overlay is provided for positioning on the gameboard in order to locate the final ball position.

2 Claims, 7 Drawing Figures

BOARD GAME USING MOVABLE TRANSPARENT OVERLAY

BACKGROUND OF THE INVENTION

1. Field of the Invention

The present invention generally relates to board games and more particularly a game which uses coordinate targeting which is simulative of various sports games involving the use of a ball in which the final ball location is determined by a semi-random method and with the game including a gameboard, discs, a spinner and a transparency to be associated with the board in a manner to enable modeling of various sport games which use a ball.

2. Disclosure Statement

Board-type games of various types are commercially available and in many instances, the games to be played are simulative of or modelled after various sport games using balls such as baseball, basketball, football, soccer, tennis and the like. Such games may be generally categorized as those in which the ball location is determined by a physical device which actually propels the ball toward the location and a category in which the ball location is determined by a random device such as a spinner, dice or other chance device. In the first type of game, the use of a physical device to propel the ball requires the development of a physical skill in order for the game to be played properly and usually such game devices do not provide for movement of both the player pieces and the ball simultaneously. The type of board games which determine the ball location through use of a random device usually depend on either a spinner or an equivalent chance device and a set of instructions to determine the ball location or only the spinner or other chance device to locate the ball relative to its original location but not relative to its target location. Neither type of game described above accurately simulates the actual process by which a ball is moved in real sports games.

The following U.S. patents represent disclosures of games and game apparatuses of which applicant is aware:

U.S. Pat. No. 614,998 Nov. 29, 1898; U.S. Pat. No. 795,822 Aug. 1, 1905; U.S. Pat. No. 1,149,753 Aug. 10, 1915; U.S. Pat. No. 2,152,882 April 4, 1939; U.S. Pat. No. 2,884,253 April 28, 1959; U.S. Pat. No. 3,920,243 Nov. 18, 1975; U.S. Pat. No. 4,060,245 Nov. 29, 1977.

SUMMARY OF THE INVENTION

Some of the above boardgames allow the participants or players some discretion in choosing a type of ball movement and modeling of a different type of interference by other playes as well as a difference in capability among players, none of them allows the players such realistic freedom of choice in the movement of the ball, none allows the precise target decision process combined with the off-target occurrence (which happens frequently in actual games), none models the ball tackling process none could easily be extended to accurately model such a game as soccer and none allows the majority of the above advantages.

An object of the present invention is to provide a coordinate targeting board game which allows a player of a board game to use strategy in the movement of the ball and players in a manner simulative of that which occurs in actual sports games involving the use of a ball.

Another object of the invention is to provide a board game which enables a player to indicate the target area for the ball to a specific location on the board with a target spinner introducing a probability that the ball will not exactly hit the target with the degree by which the target is missed being a function of the increasing total distance from the point of origin of the ball to the target location.

A further object of the invention is to provide a board game in accordance with the preceding objects in which the spinner includes a series of concentric circles each being separated into segments by radial division lines with each separated segment containing a pair of numbers indicating the ordinates of the final location of the ball relative to the target location or, in some instances, the separated segment will contain a shaded area to indicate that the ball is to be placed on target. The spinner includes a pointer rotatably mounted at the center of the concentric circles and the arrangement of the shaded areas and coordinate pairs of numbers is such as to increase the distance of the final ball location from the target as the distance of the concentric circles from the center of the spinner increases.

Yet another object of the present invention is to provide a board game in accordance with the preceding objects together with a transparency having a center which can be placed over the target in order to locate the final ball location, thereby facilitating location of the final ball location for those players not familiar with coordinate axes.

Still another object of the present invention is to provide a board game which is interesting and challenging since it introduces the use of strategy combined with a chance device for semi-random play, thereby enhancing the use of the invention in developing various skills.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
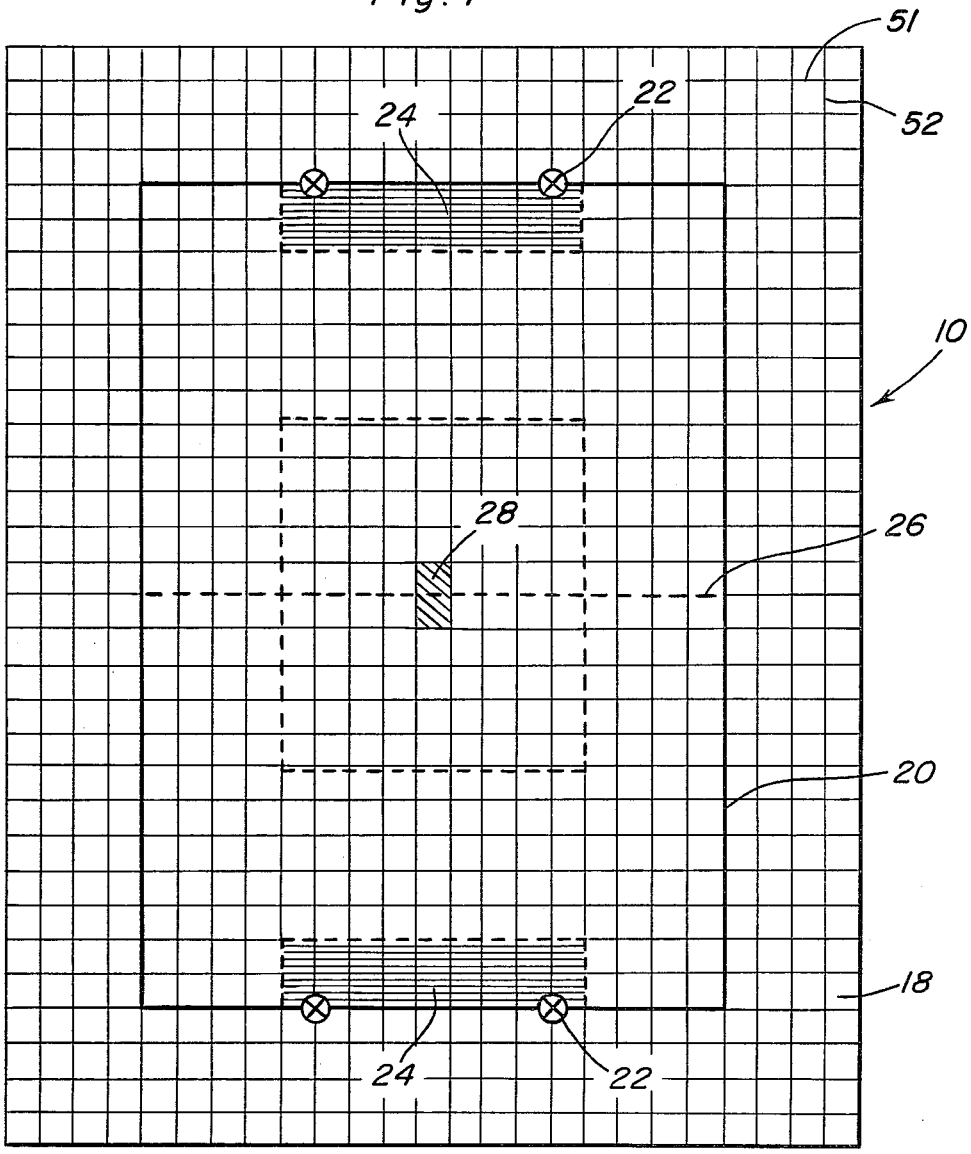
FIG. 1 is a plan view of the gameboard of the present invention.
Figure 2:
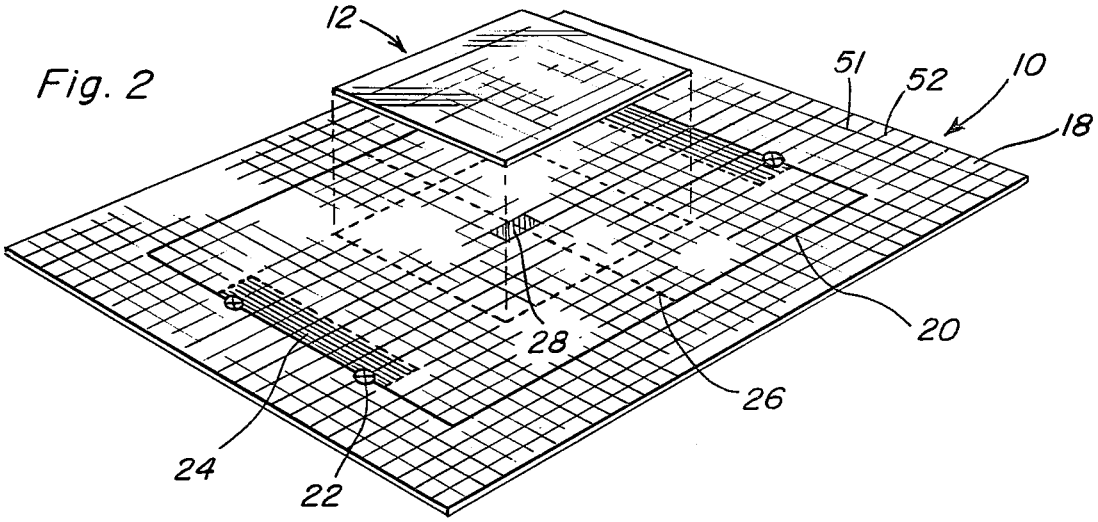
FIG. 2 is a perspective view of the gameboard with the transparent overlay positioned thereon.

The present invention includes a gameboard 10, a transparent overlay 12, a spinner 14 and player discs 16.

The gameboard 10 is of rectangular configuration and provided with a generally planar top surface 18 with the board being constructed to heavy cardboard or other materials normally used in constructing gameboards with the board also being optionally constructed with a foldline or hinge across the center thereof so that it can be folded to facilitate its storage in a container or the like. The planar top surface 18 is provided with a boundary line 20 concentric with and spaced inwardly from the periphery of the board 10. The boundary line 20 is a heavy distinguishable line and indicates a playing court, field or the like. As illustrated, the gameboard depicts a soccer field with the boundary line indicating the boundary of the playing field and at each end thereof, a pair of goal posts 22 are indicated by a circle and crossed perpendicular lines and a rectangular area inwardly of the goal posts which is designated as a goalie area 24 and which may be distinguishly colored such as being colored blue. Also, a centerline 26 is provided at the transverse center of the boundary line 20 midway between the end lines of the boundary lines 20 which have the goal posts 22 thereon and at the center of the board, two distinguishably colored square areas 28 are provided which indicate the kick-off position for the opposing teams. Lighter horizontal and vertical lines 51 and 52 within the boundary lines delineate squares on which the playing discs are placed.

Figure 3:
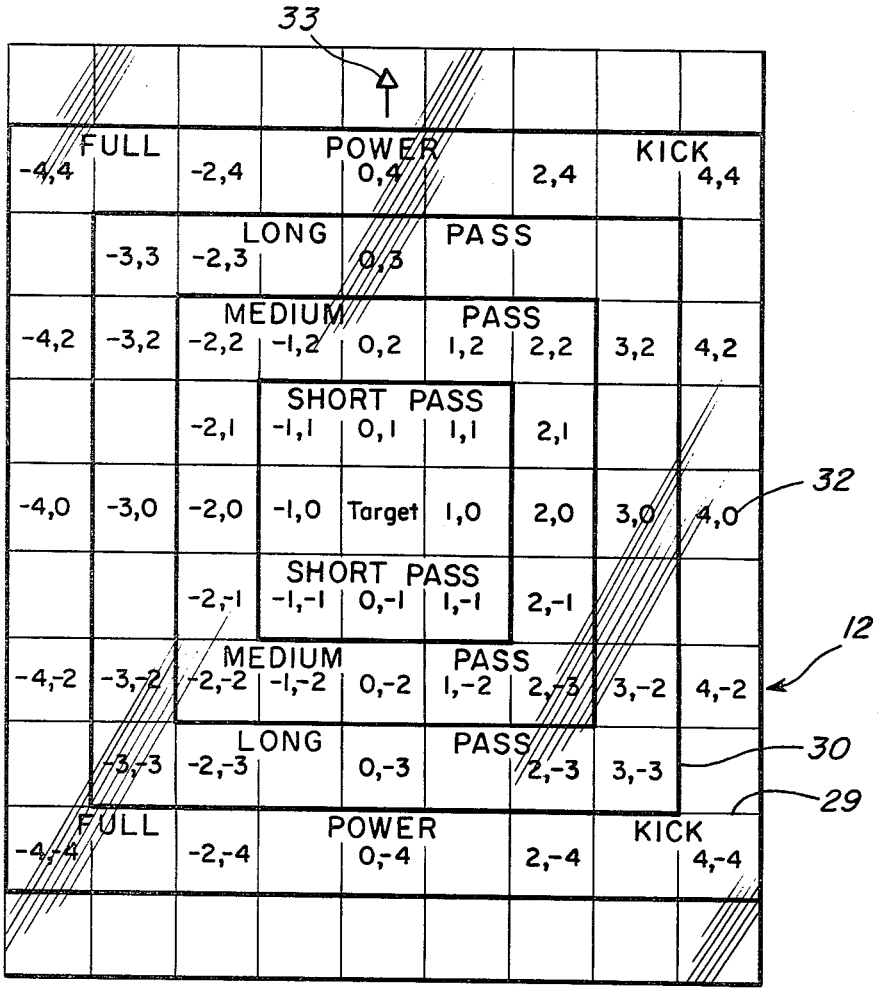
FIG. 3 is a plan view of the transparent overlay.
Figure 4:
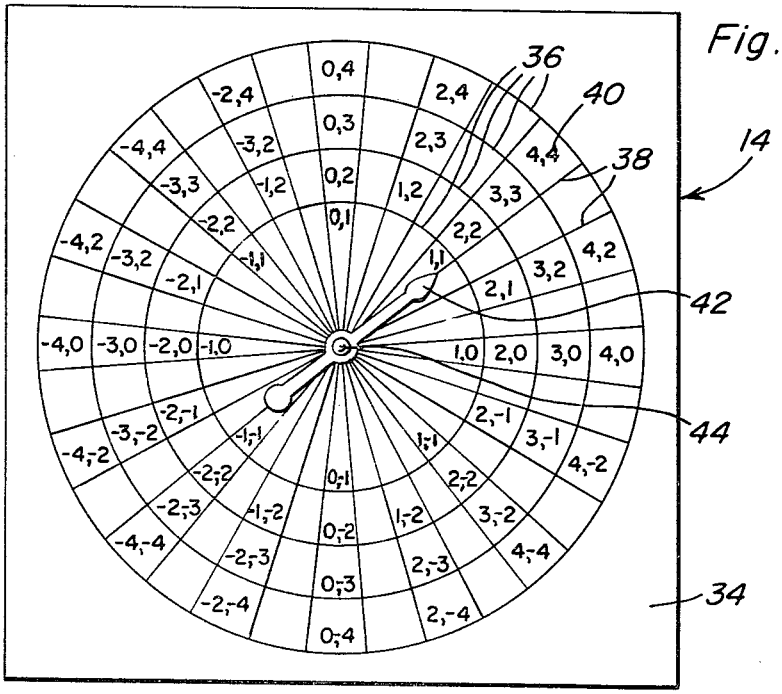
FIG. 4 is a plan view of the spinner.
Figure 5:
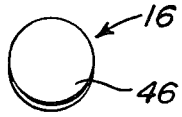
FIG. 5 is a perspective view of a plain disc.
Figure 6:
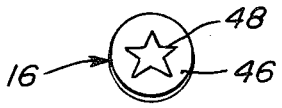
FIG. 6 is a perspective view of a disc with a star thereon.
Figure 7:
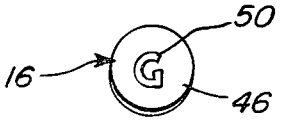
FIG. 7 is a perspective view of a disc with a G thereon.

The transparent overlay 12 is rectangular in construction and includes perpendicular division lines 29 and 30 dividing the transparent overlay into a grid with pairs of numbers 32 being provided in the square areas delineated by the lines 29 and 30. The central area of the transparent overlay is provided with the word "target" thereon and certain rows of spaces spaced from the transverse central row of spaces are provided with indicia "short pass", "medium pass", "long pass" and "full power kick" and a directional arrow 33 is provided at the center end edge of the overlay, all as illustrated in FIG. 3. The above indicia apply to the rectangularly concentric arrays of squares centered on the target square.

The spinner 14 includes a square or rectangular panel 34 of cardboard or the like having concentric circles 36 thereon which are divided into segments by radial division lines 38. Certain of the separated segments are provided with pairs of numerals 40 indicating the ordinates of a final ball location in relation to a desired ball target. A pointer 42 is rotatably journaled at the center of the concentric circles by a suitable rivet, pivot pin or the like 44.

The discs 16 are each in the form of a circular, flat member 46 with the disc of one team being one color and the discs of another team being another with their being eleven discs to each team with eight of those discs being plain and two of the discs being provided with star indicia 48 and one of the discs being provided with the letter "G" as designated by numeral 50 to indicate the goalie.

The segments of the spinner not provided with numerals may be shaded or provided with any suitable color as may be the spaces with numerals. The areas without numerals indicate that the ball landed on target whereas the spaces with the numerals indicate that the ball landed away from the target with the numerals indicating the ordinates of the final location which is determined by placing the transparent overlay with the central target area on the desired or indicated target position on the gameboard and the ordinate numerals on the transparent overlay corresponding with the ordinate numerals indicated by the spinner pointer 42 depending upon the type of play selected indicating the final location of the ball on the gameboard. This provides a semi-random ball location which enables the game to be modeled after actual sports games and makes it feasible to model ball interceptions by the opposing players' board men. Interceptions occur when a line connecting the original ball location and the final ball location crosses a square containing one of the other players' board men. The concept of modeling one man's attempt to take the ball away from another man ("tackling" in soccer terminology) is modeled in the following way. If one extra step (movement of a man to one of the eight board squares adjacent to a man) would allow a man to gain possession of the ball (be within one board square of the ball), then tackling is allowed. If tackling is allowed, a player may announce that he is tackling the ball and take one extra step. He must then spin to see whether his tackle was successful. His tackle was successful if he spins on target in the innermost circle of the spinner. If he is successful, then he is given certain positions with regard to placement of the ball. Regardless of whether the tackle was successful, the tackler ends up "on the ground" and loses his next two turns.

In an actual game, such as American soccer, a player decides where he wants the ball to go and attempts to get it there. Whether the ball gets to the player's chosen target or somewhere in the vicinity of his target depends on his skill and chance, the difficulty of what he is attempting and the interference of the players on the opposite team. The present game models the decision of the player as to where he wants the ball to go, in that this is entirely the decision of the participant. It models the fact that the ball will probably end up somewhere close to where he wanted it to go but introduces a chance that it will be off target. Further, it models the probability that the more difficult (longer) the ball movement (pass) attempted, the further from the the target the ball may stray. It also allows for the interference of other players and in the form of the other participants player pieces intercepting off target passes when the defensive player is in an appropriate position. Further, in addition to the normal process of securing possession of the ball, it allows for the modeling of the "tackling" process by which a player of one team deliberately and actively attempts to take the ball away from a player of the other team, thus leaving the tackling player temporarily out of play. Finally, the present game allows for difference of ability among the players in the form of the star players who have extra movement capabilities.

Other boardgames besides soccer and particular hockey and basketball, may be modeled using the devices of the present invention and the semi-random coordinate targeting, interception modeling and tackling modeling. However, soccer is the game best modeled by the present invention and a set of game rules to play "Soccer Stars" is set forth hereinafter.

"Soccer Stars" is designed to model actual soccer play in matters relating to the movement of soccer men and the soccer ball, allowing players to learn and practice soccer strategy. All of the rules below are essential to the play of the game except the tackling rule, which is optional. A set of suggestions for handicap games is given so that players of unequal skill (particularly children versus adults) may play each other with each winning about half of the games.

1. Object of the Game

The object of the game is to score the most goals by passing or dribbling the ball through the opponent's goal posts. The first player to score 3 goals wins the game. Alternatively, for shorter games, the winner is the first one to score a goal.

2. Start of the Game

Determine who kicks off by the flip of a coin for the first game; therafter, the loser of the previous game kicks off. Each player chooses 11 discs of one color. Eight of these discs should be plain for regular soccer men, two of these discs should have stars on them for star soccer players, and one of them should have a "G" on it for the goalie. The player whose team is kicking off may place his playing discs (referred to as "men" henceforth) anywhere on his half of the field. The other player may place his men anywhere on his half of the field except within four squares of the kick-off position of the ball. For the kick off, the ball is placed in the marked square at the center of the field on the opponent's side of the field and the man kicking it off on the adjacent square on his own side of the field.

3. A Player's Turn

A player's turn consists of moving any or all of his men and moving the ball if he is in possession of the ball. A man is in possession of the ball if the ball is on one of the 8 squares adjacent to the man. Men who do not move the ball must be moved after the ball has been moved. The man who moves the ball may be moved after he moves the ball if he is already in possession of the ball. The man may be moved before he moves the ball if he needs to move himself to a square on which he has possession of the ball. No man nor ball may occupy the same square at the same time.

4. Moving the Players

Each player may normally be moved to any one of the 8 squares adjacent to him. A star player is allowed two such moves per turn, allowing him to move to any of the 16 nearest squares.

5. Moving the Ball

The ball may be moved either by dribbling the ball or passing it. Four types of passes are allowed: a short pass, a medium pass, a long pass, and a full power kick. The player with a man in possession of the ball tells the other player what type of ball move his man will make. If it is a dribble, the ball is placed exactly on the target square specified by the player. If it is a pass, the player again specifies which square is the target square, but then must spin the target spinner to determine how close he came to his target. The shorter the pass, the closer he will come to his target square if he misses the target. If the player's spin points to the shaded area for the type of pass he announced before spinning, then the ball is placed on the target square. If not, the ball is placed according to the number pair pointed by the spinner in the circle for that type of pass. Use the overlay transparency to determine the location of where the ball goes (final ball location) relative to the target square. Point the arrow on the transparency toward the opponent's goal, and place the center square of the transparency over the target square.

The allowed location of the target square depends on the type of pass chosen and is given below in terms of steps. A step is a move to any of the 8 squares adjacent to the ball. The target square for a dribble by a normal player is one step. For a star player it is either one or two steps. The target square for a short pass is 2, 3 or 4 steps. Use the inner circle of the target spinner for a short pass. The target square for a medium pass is 5 or 6 steps. Use the second circle out for a medium pass. The target square for a long pass is 7 or 8 steps. Use the third circle out for a long pass. The target circle for a full power kick is 9 or 10 steps. Use the outer circle for a full power kick.

6. Out of Bounds

If the ball goes out of bounds (outside of the dark field boundary 4 squares inside the outermost boundary), the ball is placed back in bounds on the square nearest where it went out and play continues. The side that kicked the ball out may not move the ball until the opposite side has moved it first.

7. Scoring a Goal

A goal is scored when a straight line connecting the original ball position and the final ball position, after the spin, crosses the goal line between the goal posts. After a goal is scored, the opposite side gets the kick-off at the center of the field and all players are repositioned on their side of the field with the non-kick-off team outside of the (green) center kick-off area.

8. Interceptions

If a straight line connecting the starting location and the final location of the ball crosses a square containing a man of the opposite team, then the ball is replaced on the square adjacent to the intercepting man which the line crossed before crossing the man's square. The above does not apply to high passes, which may not be intercepted, except by the goalie in the blue colored goalie area.

9. High Passes

A player may, prior to his spin, designate his pass as a high pass. A high pass may not be intercepted except by the goalie when he is in the blue goalie area. However, if one player chooses a high pass, the other player on his next move may move any or all his players one extra step.

10. Tackling

If one extra step would allow a man to gain possession of the ball, then he may announce that he is tackling the ball and take that extra step. He must then spin to see whether his tackle was successful. His tackle was successful if he spins on target in the innermost circle of the spinner. If he is successful then he may dribble or spin again for a short pass. No other types of passes are allowed for a tackler. Regardless of whether the tackler was successful or not, he ends up "on the ground" and looses his next two turns.

11. Goalie Powers

For short and medium passes, the goalie's interception area is one square, as for other men. For a long pass the goalie's interception area is his square plus the 8 squares adjacent to him. For a full power kick the goalie's interception area is his square plus the 24 squares nearest him. The goalie may intercept high passes as well as low passes in all cases. If the ball passes over the goalie's interception area, it stops the ball as for other interceptions. The goalie may then move adjacent to the intercepted ball before beginning his regular turn.

12. Fine Points—Basic Set

The following set of rules should be referred to when special circumstances arise.

(a) Failure to announce type of pass

If a player spins without first announcing his target and type of pass, he must announce and respin.

(b) Surrounding the ball not allowed

At most two men on one team may be adjacent to the ball.

(c) Option not to move the ball

A man in possession of the ball does not have to move the ball during his turn.

(d) Score through wrong goal

An off target pass which passes through one's own goal counts as a goal for the opponent.

(e) Hitting the goal posts

If a straight line connecting the original ball location and the final ball location passes exactly through the intersection of the lines on which a goal post sets, it is treated in the same way as an interception. The ball is placed on the field on the square in front of the goal post on the side from which the ball came. No goal is scored on the move.

(f) Final ball location off the field

In order to score a goal, the shooter must target the ball to a square behind the goal line. This allows the possibility that the ball will go entirely off the board. If it does, no goal is scored and the ball is placed back on the field and the usual out of bounds rules apply.

(g) No interceptions at corner of square

For a man to intercept the ball, the line between the original and final ball locations must pass over a finite length of his square, passing over the exact corner of his square does not count as an interception.

(h) Ball landing on man

The ball may not be targeted to a square containing a man. If the final location of the ball is on the square containing a man due to an off target pass, the player whose man it is may place the ball on any one of the 8 squares adjacent to that man.

(i) Suggestion on Moving Men

In order to avoid moving a man more than once, it is suggested that all men be moved from left to right and top to bottom as one would read a book.

13. Handicap Suggestions

Adults playing children should start out playing without any star players, using regular players in place of them. If the handicapped player still wins most of the games, he should play with 10 or fewer men until the game is even.

Other well known games may be played on a similar gameboard with the components of the game and rules of play being modified in accordance with the particular game to be modeled. For example, if hockey is modeled, similar rules are followed but the nomenclature relates to hockey. Likewise, similar changes would be made in modeling football, basketball and the like.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A board game device for simulating the play of a ball game comprising a gameboard having a generally planar top surface, a plurality of discs simulative of balls used in a game, said top surface including indicia designating a boundary line defining a rectangular area with the area enclosed by the boundary line including grid division lines defining target areas for locating a ball simulating disc used in playing a game, chance control means for indicating the final location of a disc in relation to the target position of a disc, and a transparent overlay positionable on the gameboard to indicate the final position of the disc in relation to the target position thereof as determined by the chance control means, said chance control means including a spinner comprising a base panel having a plurality of concentric spaced circles thereon divided into circumferential segments by radial division lines and a rotatable pointer journaled for rotation at the center of the concentric circles, certain of said segments defined by the concentric circles and radial division lines including ordinate numbers to indicate the coordinates of the relationship of the final position of the ball simulating disc to the target position thereof, said overlay including a grid thereon with ordinate numbers in certain areas corresponding to the ordinate numbers on the spinner to indicate the final position of the ball simulating disc, the ordinate numbers in the segments of the spinner increasing in numerical value from the inner circles toward the outer circles thereby increasing the distance between the target area and final position of a disc in accordance with the difficulty of the movement of the disc from an initial position toward a target area, said boundary line on the gameboard enclosing an area simulative of a soccer field and provided with goal posts at each end thereof and a goalie area inwardly of the boundary line adjacent the goal posts, a transverse centerline between the ends of the enclosed area, a kick-off square designated at the center of the enclosed area on both sides of the centerline to indicate a kick-off area for each team with the grid division lines enabling positioning of a disc thereon, certain of said discs being plain, some being provided with indicia to designate star players and a goalie with the discs being capable of movement in different manners on the top surface of the gameboard commensurate with their status.

2. The structure as defined in claim 1 wherein certain of the circumferential segments on the spinner are blank with the blank spaces being in radial alignment and the ordinate numbers being in radial alignment with the blank spaces and spaces with ordinate numerals alternating circumferentially around the spinner, said transparent overlay also including spaced concentric heavy lines designating concentric areas thereon with indicia in each area indicating the type of play selected by a player of the game with the ordinate numbers increasing in value from the center of the transparent overlay toward the outer edges thereof.

* * * * *